US009239561B2

(12) United States Patent
Azami

(10) Patent No.: US 9,239,561 B2
(45) Date of Patent: Jan. 19, 2016

(54) IMAGE FORMING APPARATUS

(71) Applicant: CANON KABUSHIKI KAISHA, Tokyo (JP)

(72) Inventor: Mitsuo Azami, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/535,695

(22) Filed: Nov. 7, 2014

(65) Prior Publication Data

US 2015/0130341 A1 May 14, 2015

(30) Foreign Application Priority Data

Nov. 14, 2013 (JP) ..... 2013-236200

(51) Int. Cl.
*G03G 21/16* (2006.01)

(52) U.S. Cl.
CPC ..... *G03G 21/1619* (2013.01); *G03G 21/1623* (2013.01); *G03G 21/1647* (2013.01); *G03G 2221/1654* (2013.01); *G03G 2221/1684* (2013.01)

(58) Field of Classification Search
CPC combination set(s) only.
See application file for complete search history.

(56) References Cited

U.S. PATENT DOCUMENTS

2008/0138111 A1* 6/2008 Ju et al. ..... 399/121
2011/0293326 A1* 12/2011 Tanabe et al. ..... 399/124

FOREIGN PATENT DOCUMENTS

JP 2011-191400 A 9/2011

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes an apparatus body, a drawer unit drawably stored in the apparatus body, a plurality of interlocked lock portions configured to lock the drawer unit to the apparatus body in a state in which the drawer unit is stored in the apparatus body, an interlocking portion configured to interlock the interlocked lock portions, and an independent lock portion configured to move independently from the plurality of interlocked lock portions and disposed so as to lock the drawer unit to the apparatus body.

20 Claims, 10 Drawing Sheets

(a)

(b)

IMAGE FORMING APPARATUS

BACKGROUND OF THE INVENTION

1. Field of the Invention

The present invention relates to an image forming apparatus and more specifically to a lock mechanism configured to lock a drawer unit drawably stored in a body of the image forming apparatus.

2. Description of the Related Art

A conventional image forming apparatus such as a copier and a printer is configured to form an image on a sheet conveyed to an image forming portion from a sheet storage portion and to discharge the sheet on which the image has been formed out of a body of the image forming apparatus (referred to an 'apparatus body' hereinafter). Here, there is such an image forming apparatus having a unit drawably stored in the apparatus body. In removing a jammed sheet and replacing a component the drawably stored unit of the image forming apparatus is configured drawn out.

Japanese Patent Application Laid-open No. 2011-191400 discloses an image forming apparatus configured to unlock a unit locked to the apparatus body by two lock members. The unit is unlocked by manipulating two drawing levers provided at a center part of the unit. A user draws the unit out of the apparatus body by pulling the drawing levers after the unit is unlocked when the drawing levers are manipulated. When the user ends a work, such as an unjamming work, performed in a condition in which the unit has been drawn out, the user pushes the unit into the apparatus body using the drawing levers to store and then locks the unit by manipulating the two drawing levers.

Here, if the timing for manipulating the two drawing levers to lock the unit are not coordinated, there is a possibility of causing an unbalanced closure by which either one of the two lock members becomes inoperative. It is not preferable to execute an operation of forming an image on a sheet in the condition in which the unit is closed in the unbalanced manner because skewing and jamming of the sheet are liable to occur. As a result, the image forming apparatus disclosed in Japanese Patent Application Laid-open No. 2011-191400 is provided with a link member, linking the two lock members and preventing unbalanced closure by interlocking the two drawing levers and the two lock members.

However, because the two drawing levers are provided at the center part of the unit in the image forming apparatus described in Japanese Patent Application Laid-open No. 2011-191400, there is such a case that it is hard for the user to manipulate the drawing levers and the lock members depending on disposition and size of the unit and on a place where the image forming apparatus is installed.

Still further, if the user pushes the unit into the image forming apparatus by holding end portions of the unit, not the two drawing levers provided at the center part, the unit may be substantially leaned with respect to a direction into which the unit is pushed because forces for pushing the unit are applied to the end portions of the unit. If the user tries to lock the unit by manipulating the drawing levers in the condition in which the unit is leaned as described above, there is a possibility of causing an unbalanced closure of the unit.

SUMMARY OF THE INVENTION

According to one aspect of the invention, an image forming apparatus includes an apparatus body, a drawer unit drawably stored in the apparatus body, a plurality of interlocked lock portions configured to lock the drawer unit to the apparatus body in a state in which the drawer unit is stored in the apparatus body, an interlocking portion configured to interlock the interlocked lock portions, and an independent lock portion configured to lock the drawer unit to the apparatus body independently from the plurality of interlocked lock portions.

Further features of the present invention will become apparent from the following description of exemplary embodiments (with reference to the attached drawings).

DESCRIPTION OF THE EMBODIMENTS

Figure 1:
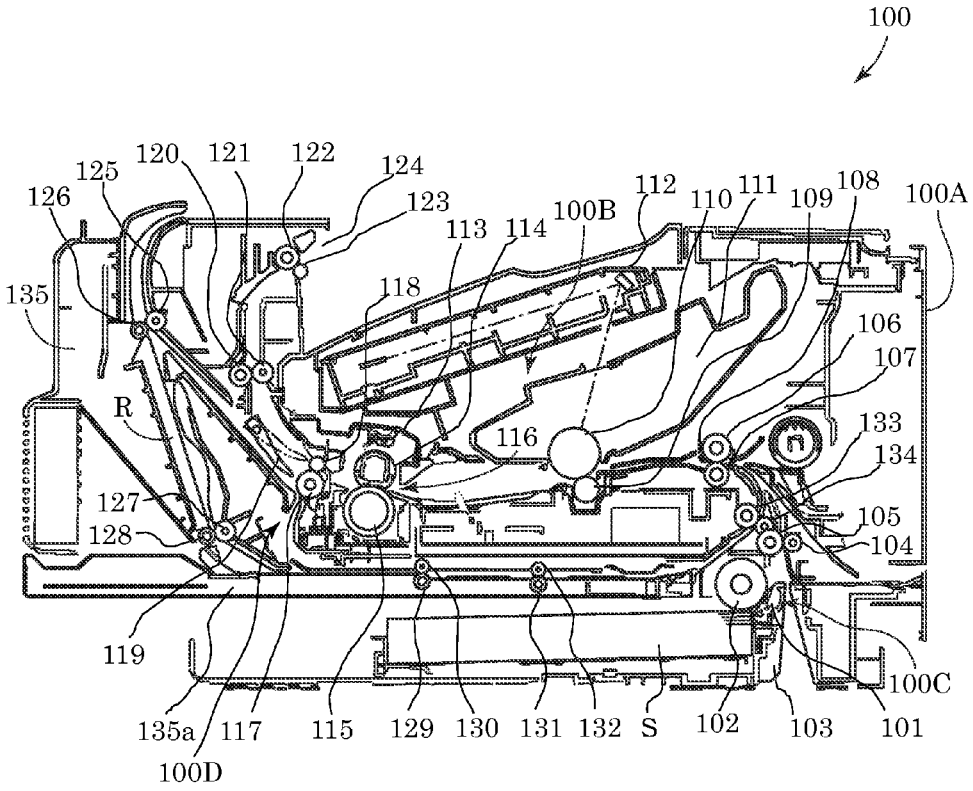
FIG. 1 is a schematic diagram showing an entire structure of an image forming apparatus according to an embodiment of the present invention.

A mode for carrying out the invention will be described below in detail with reference to the drawings. FIG. 1 is a schematic diagram showing an entire structure of an image forming apparatus of the embodiment of the present invention. As shown in FIG. 1, the image forming apparatus 100 composing a copier and a printer for example includes a body 100A of the image forming apparatus 100 (referred to as an 'apparatus body' hereinafter) composing a casing of the image forming apparatus 100. The apparatus body 100A includes an image forming portion 100B having a photosensitive drum 110 and others and a sheet feeding apparatus 100C provided at a lower part of the apparatus body 100A and feeding a sheet S such as a recording medium stacked and stored in a sheet feed cassette 103 to the image forming portion 100B. The apparatus body 100A is also provided with a storage portion 100D in which a duplex unit 135 described later is stored at one side surface of the apparatus body 100A.

This apparatus body 100A also includes a transfer roller 109 abutting against the photosensitive drum 110 and composing a transfer portion together with the photosensitive drum 110, a fixing unit 113 fixing a toner image transferred in the transfer portion to the sheet S, and others. The duplex unit 135 including a reverse conveying path R which is a sheet conveying path for reversely conveying a sheet on which an image has been formed on one surface thereof and conveying the sheet again to the image forming portion 100B is disposed between the image forming portion 100B and the sheet feed cassette 103. It is noted that the duplex unit 135 is disposed drawably in the apparatus body 100A.

Here, the image forming portion 100B includes the photosensitive drum 110 and a process cartridge 111 including a charger, a developer sleeve, a cleaning portion and others not shown. The image forming portion 100B also includes a laser scanner 112 forming an electrostatic latent image on the photosensitive drum 110 by exposing a surface of the photosensitive drum 110. The sheet feeding apparatus 100C includes a pickup roller 102 feeding an uppermost sheet S stacked in the sheet feed cassette 103. The sheet feeding apparatus 100C also includes a separation pad 101 being in pressure contact with the pickup roller 102 and separating and conveying the sheet S fed from the pickup roller 102 one by one together with the pickup roller 102.

Next, an image forming operation of the image forming apparatus 100 constructed as described above will be explained. In response to a start of the image forming operation, the photosensitive drum 110 rotates at first such that the surface thereof is charged by the charger not shown. Then, a laser beam is irradiated to the photosensitive drum 110 on a basis of image information from the laser scanner 112. Thereby, an electrostatic latent image is formed on the photosensitive drum 110. Next, toner adequately electrified by rotation of the developing sleeve not shown is supplied on the photosensitive drum 110, so that this electrostatic latent image is developed and visualized as a toner image.

Meanwhile, in parallel with such a toner image forming operation, the pickup roller 102 rotates by being driven by a driving motor not shown and feeds the uppermost sheet S in the sheet feed cassette 103. The sheet S fed by the pickup roller 102 is conveyed while being separated one by one by the pickup roller 102 and the separation pad 101. After that, the sheet S is conveyed through a conveying roller pair 104 and 105 to a registration roller pair 106 and 107.

Here, the registration driven roller 106 composing the registration roller pair 106 and 107 is provided with a coaxially rotatable registration shutter 108 such that the registration shutter 108 corrects a skew of the sheet S conveyed thereto. The sheet S whose skew has been corrected is conveyed to the transfer portion by the registration roller pair 106 and 107, and the image on the photosensitive drum 110 is transferred to the sheet S by the transfer roller 109. After that, the sheet S on which the toner image has been transferred is conveyed to a fixing nip portion 116 composed of a heating unit 114 and a pressure roller 115 of the fixing unit 113 so that the non-fixed toner image is fixed on a surface of the sheet by heat and pressure.

The sheet S on which the toner image has been fixed is conveyed to a conveying roller pair 117 and 118 and is then conveyed to an intermediate discharge roller pair 120 and 121 by being guided by a switching member 119 located at a position indicated by a solid line in FIG. 1. Then, the sheet S is conveyed to a discharge roller pair 122 and 123 by the intermediate discharge roller pair 120 and 121 and is then discharged out of the apparatus body 100A through a discharge port 124.

Meanwhile, in a case of forming images on both surfaces of the sheet S, the sheet S is conveyed to a normally/reversely rotatable switchback roller pair 125 and 126 by being guided by the switching member 119 that has moved to a position indicated by a dot line in FIG. 1 after being conveyed to the conveying roller pair 117 and 118. Then, the sheet S is conveyed by a predetermined distance by normal rotation of the switchback roller pair 125 and 126 and is then conveyed to a reverse conveying path R of the duplex unit 135 by reverse rotation of the switchback roller pair 125 and 126.

After that, the sheet S is conveyed through duplex first, second, third and fourth roller pairs 127 and 128, 129 and 130, 131 and 132, and 133 and 134 provided respectively along the reverse conveying path R. After that, the sheet S is conveyed again to the registration roller pair 106 and 107 by the duplex fourth roller pair 133 and 134. Then the sheet is conveyed by the registration roller pair 106 and 107 to the transfer portion where an image is formed on a back surface side of the sheet S. After that, the image formed on the back surface side of the sheet S is fixed by the fixing unit 113 and the sheet S is discharged out of the apparatus.

Figure 2:
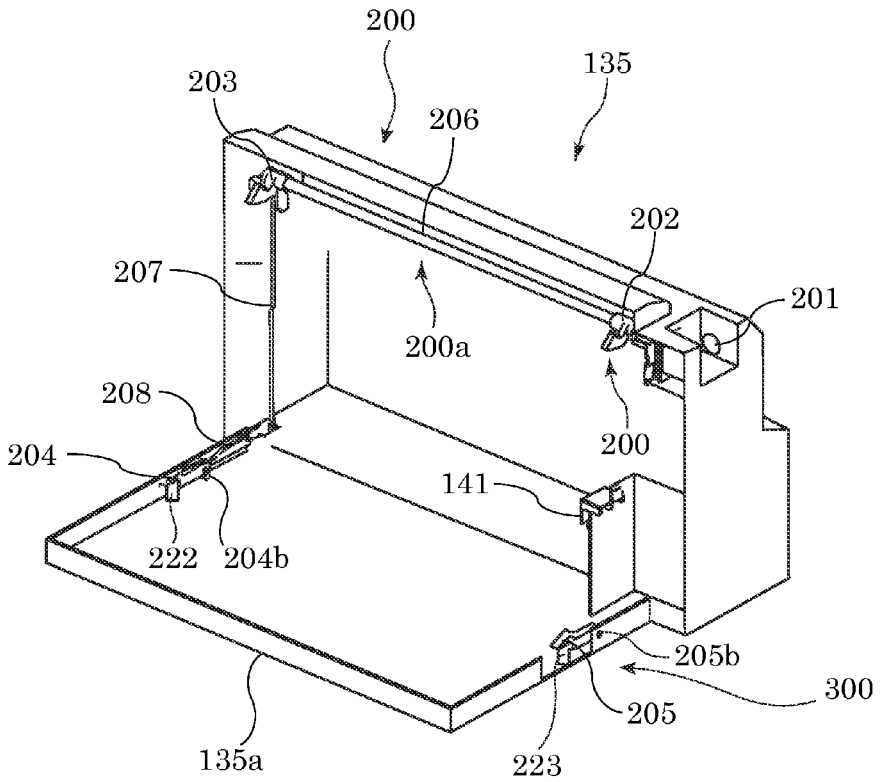
FIG. 2 is a perspective view showing a duplex unit drawably provided in a body of the image forming apparatus.
Figure 3:
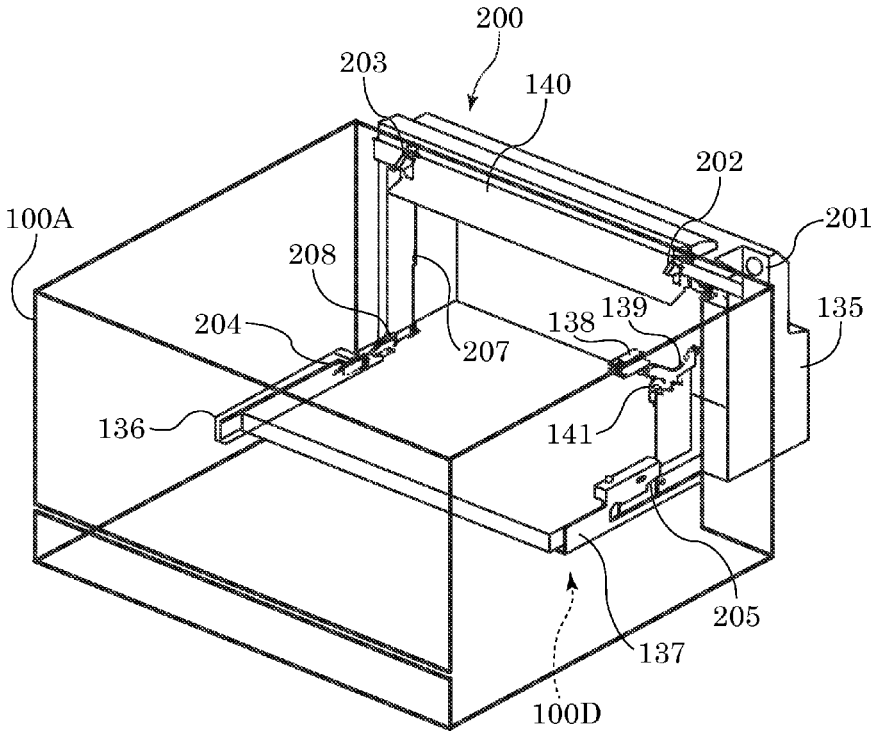
FIG. 3 is a perspective view showing a state in which the duplex unit is stored in the apparatus body.
Figure 4:
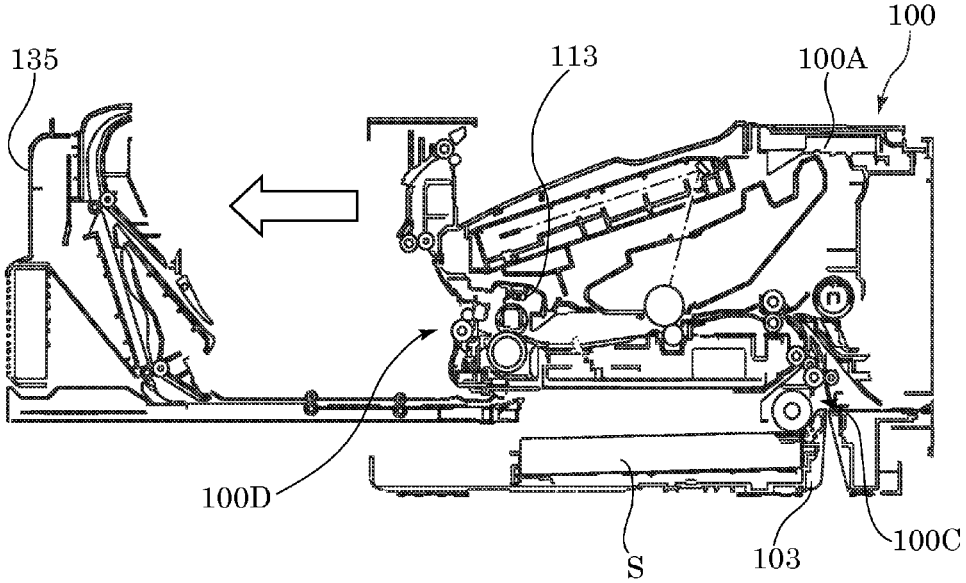
FIG. 4 is a schematic diagram showing a state in which the duplex unit is drawn out of the apparatus body.

Here, the duplex unit 135 (i.e., one exemplary drawer unit drawably provided in the apparatus body 100A) is provided with a support portion 135*a* at a lower end portion as shown in FIG. 2. It is noted that components such as the switching member 119 and the switchback roller pair 125 and 126 are not shown in FIG. 2. As shown in FIG. 3, the duplex unit 135 is drawably stored in the apparatus body 100A such that both end portions of the support portion 135*a* are mounted on guide rails 136 and 137, and provided so as to face inner wall surfaces of a storage portion 100D formed in the apparatus body 100A. Then, in a case where jamming of the sheet or the like occurs in the fixing unit 113 or the duplex unit 135, a user of the image forming apparatus can perform unjamming work by drawing the duplex unit 135 out of the apparatus body 100A in a direction of an arrow as indicated in FIG. 4.

It is noted that the storage portion 100D is provided with a detection switch 138 detecting that the duplex unit 135 is stored at a normal storage position as shown in FIG. 3 described above. The storage portion 100D is also provided with a flag 139 turning ON/OFF the detection switch 138 as shown in FIG. 3. Meanwhile, the duplex unit 135 is provided with a switch arm 141 as shown in FIG. 2. Then, when the duplex unit 135 is stored in the storage portion 100D, the flag 139 is pressed and moved by the switch arm 141 and turns ON the detection switch 138. Thereby, a control portion not shown detects that the duplex unit 135 is stored within the storage portion 100D.

By the way, the duplex unit 135 is normally locked by an interlocked lock mechanism 200 and an independent lock mechanism 300 shown in FIG. 3 in a state being stored in the storage portion 100D. Then, the duplex unit 135 is configured such that the duplex unit 135 can be drawn out of the storage portion 100D as shown in FIG. 4 by unlocking the interlocked lock mechanism 200 when jamming or the like occurs.

Next, the interlocked lock mechanism 200 and the independent lock mechanism 300 configured to lock the duplex unit 135 as described above will be explained. As shown in FIG. 2, the interlocked lock mechanism 200 includes a first interlock hook 202, i.e., a first interlock member, a second interlock hook 203, i.e., a second interlock member, a third interlock hook 204, i.e., a third interlock member, an opening/closing lever 201 provided at a first end portion of the duplex unit 135 and releasing the lock, and an interlocking portion 200*a* configured to interlock the first through third interlock hooks 202 through 204 as described later. Thus, the interlocked lock mechanism 200 is configured to lock the duplex unit 135 by the first through third interlock hooks 202 through 204 and to unlock the duplex unit 135 by the opening/closing lever 201, i.e., a releasing portion, in the present embodiment.

The independent lock mechanism 300 is configured independently from the interlocked lock mechanism 200 and includes an independent hook 205, i.e., an independent locking member.

The duplex unit 135 is provided with a lock shaft 206 rotatably extended in a widthwise direction orthogonal to a drawing direction at an upper part thereof. The first interlock hook 202 is fixed at one widthwise end of the lock shaft 206 in a vicinity of the opening/closing lever 201, and the second interlock hook 203 is fixed at another widthwise end of the lock shaft 206. The second interlock hook 203 is connected with a first end of a vertically extending wire 207, and a second end of the wire 207 is connected to a link arm 208. An end of the link arm 208 on an opposite side from the side thereof to which the second end of the wire 207 is connected is connected to a rotation shaft 204*b* rotatably supported by the support portion 135*a*. The third interlock hook 204 is vertically rotatably connected to the rotation shaft 204*b*. The independent hook 205 is provided vertically rotatably centering on a rotation shaft 205*b* under the first interlock hook 202. That is, the first interlock hook 202 and the independent hook 205 are disposed at the widthwise first end side of the duplex unit 135, and the second and third interlock hooks 203 and 204 are disposed at a widthwise other end side of the duplex unit 135. Still further, the first and second interlock hooks 202 and 203 are disposed at an upper part of the duplex unit 135 and the third interlock hook 204 and the independent hook 205 are disposed at a lower part of the duplex unit 135.

Figure 5:
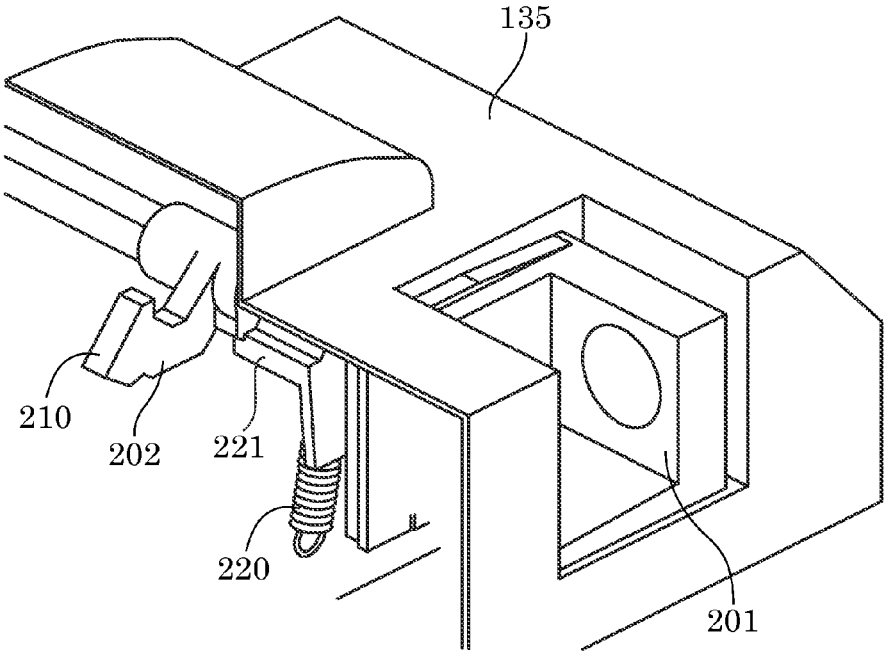
FIG. 5 is a perspective view showing an opening/closing lever unlocking a lock state of the duplex unit by an interlock member.

A lock member 221 shown in FIG. 6A and described later is attached at a first end portion of the lock shaft 206 where the first interlock hook 202 is provided. The lock member 221 is attached with a second end of a spring (interlock side bias member) 220 shown in FIG. 5 and whose a first end is anchored to an anchor portion not shown of the duplex unit 135. The lock shaft 206 is biased by this spring 220 through the intermediary of the lock member 221 in a direction in which the first and second interlock hooks 202 and 203 are turned upward. It is noted that a turning angle of the lock member 221 biased by the spring 220 is restricted by a stopper not shown. Still further, a rotational direction of the lock shaft 206 in which the second interlock hook 203 shown in FIG. 5 turns upward will be assumed to be clockwise and the rotational direction of the lock shaft 206 in which the second interlock hook 203 turns downward will be assumed to be counterclockwise in the present embodiment.

Then, in response to an operation of the opening/closing lever 201, the lock member 221 is pressed by an interlock mechanism not shown, and thereby, the lock shaft 206 provided with the first and second interlock hooks 202 and 203 at the widthwise both ends thereof turns counterclockwise by resisting against a bias force of the spring 220. Due to this rotation of the lock shaft 206, the first and second interlock hooks 202 and 203 turn downward.

Here, a first interlocked lock portion 20 partly composed of the first interlock hook 202 and a second interlocked lock portion 30 partly composed of the second interlock hook 203 will be explained in detail. As shown in FIG. 6A, the first interlocked lock portion 20 is composed of the first interlock hook 202 and a square hole (first engage portion) 140*a* formed through a hooking sheet metal 140 fixed to the storage portion 100D. The square hole 140*a* is provided on a widthwise first end side of the apparatus body 100A. An inclined surface (first inclined surface) 210 is formed at an upper surface of a protruding end portion of the first interlock hook 202. The first interlock hook 202 is provided with a concave portion 202*a* formed so as to be dented downward from an upper surface of the inclined surface 210 and to engage with an upper edge portion of the square hole 140*a* between the inclined surface 210 and the lock shaft 206. The first interlock hook 202 turns between a lock position (position shown in FIG. 6A) in which the concave portion 202*a* engages with the upper edge portion of the square hole 140*a* and an unlock position in which the first interlock hook 202 turns downward from the lock position and the concave portion 202*a* is disengaged from the square hole 140*a*.

Figure 6A:
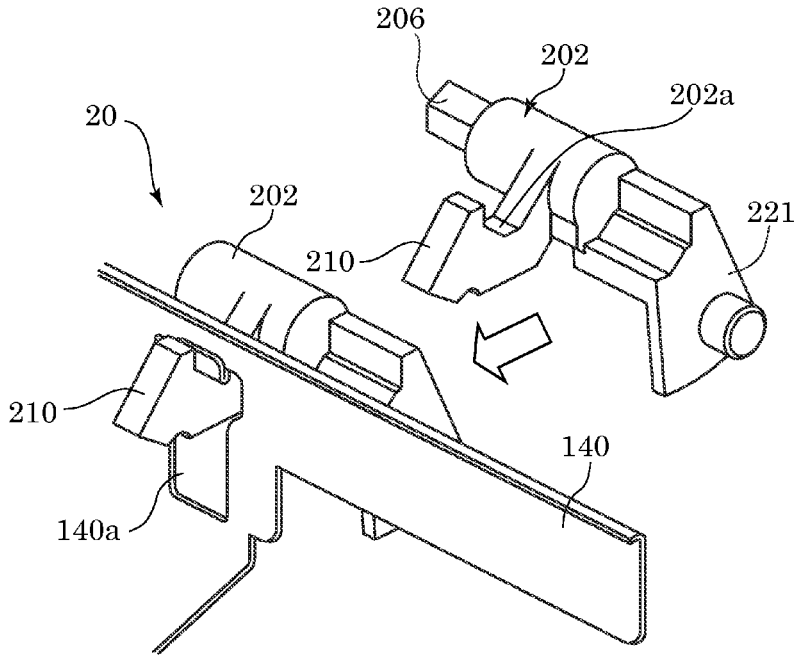
FIG. 6A is a perspective view showing a locking operation of a first interlock hook.
Figure 6B:
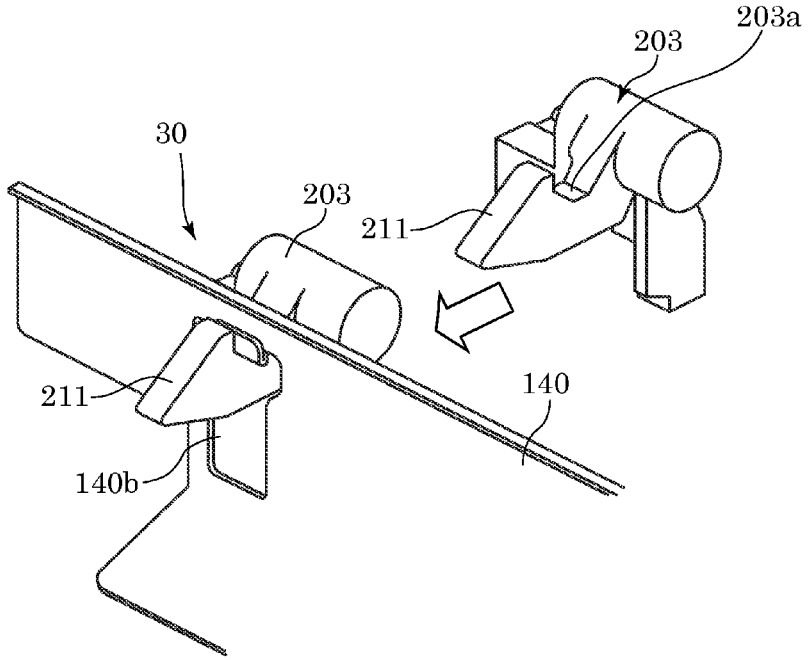
FIG. 6B is a perspective view showing a locking operation of a second interlock hook.

As shown in FIG. 6B, the second interlocked lock portion 30 is composed of the second interlock hook 203 and a square hole (second engage portion) 140*b* formed through the hooking sheet metal 140. The square hole 140*b* is provided on a widthwise other end side of the apparatus body 100A. An inclined surface (second inclined surface) 211 is formed at an upper surface of a protruding end portion of the second interlock hook 203. The second interlock hook 203 is provided with a concave portion 203*a* formed so as to be dented downward from an upper surface of the inclined surface 211 and to engage with an upper edge portion of the square hole 140*b* between the inclined surface 211 and the lock shaft 206. The second interlock hook 203 turns between a lock position (position shown in FIG. 6B) in which the concave portion 203*a* engages with the upper edge portion of the square hole 140*b* and an unlock position in which the second interlock hook 203 turns downward from the lock position and the concave portion 203*a* is disengaged from the square hole 140*b*. It is noted that the spring 220 described above biases the first and second interlock hooks 202 and 203 respectively to the lock position. Then, when the duplex unit 135 is moved to be stored in the storage portion 100D and the first and second interlock hooks 202 and 203 reach the hooking sheet metal 140, the inclined surfaces 210 and 211 are depressed by the upper edge portions of the square holes 140*a* and 140*b*, respectively.

Thereby, the first and second interlock hooks 202 and 203 turn downward while turning the lock shaft 206 counterclockwise by resisting against the bias force of the spring 220 and pass through the square holes 140*a* and 140*b* of the hooking sheet metal 140, respectively. Then, when the inclined surfaces 210 and 211 pass through the square holes 140*a* and 140*b*, respectively, the lock shaft 206 turns clockwise by the bias force of the spring 220. Due to that, the first interlock hook 202 moves to the lock position where the concave portion 202*a* is locked by the square hole 140*a* of the hooking sheet metal 140 as shown in FIG. 6A. The second interlock hook 203 also moves to the lock position where the concave portion 203*a* is locked by the square hole 140*b* of the hooking sheet metal 140. It is noted that the first and second interlock hooks 202 and 203 locked by the square holes 140*a* and 140*b* are held at the lock positions, respectively, by the spring 220.

Figure 7A:
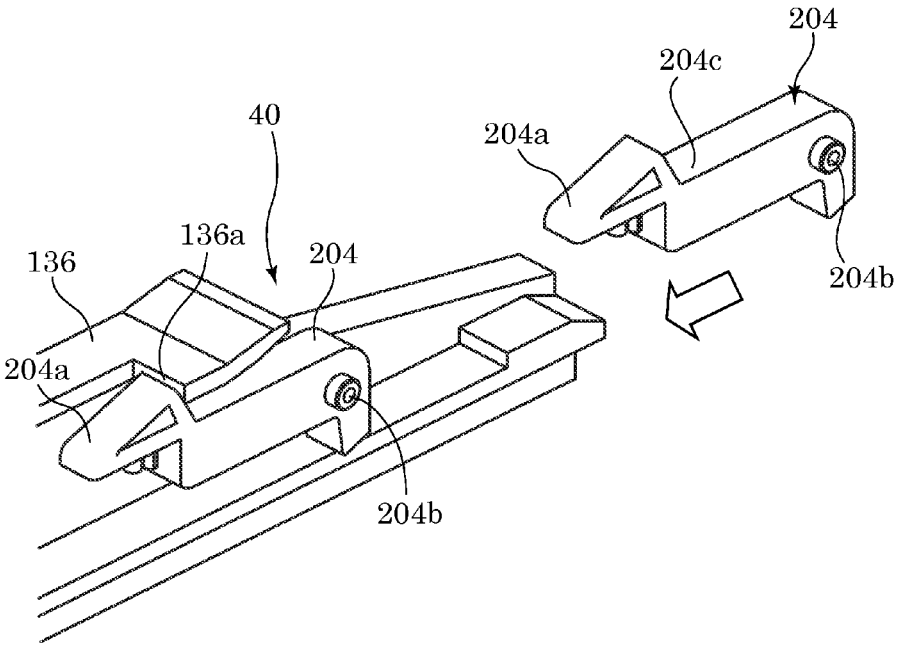
FIG. 7A is a perspective view showing a locking operation of a third interlock hook.
Figure 8:
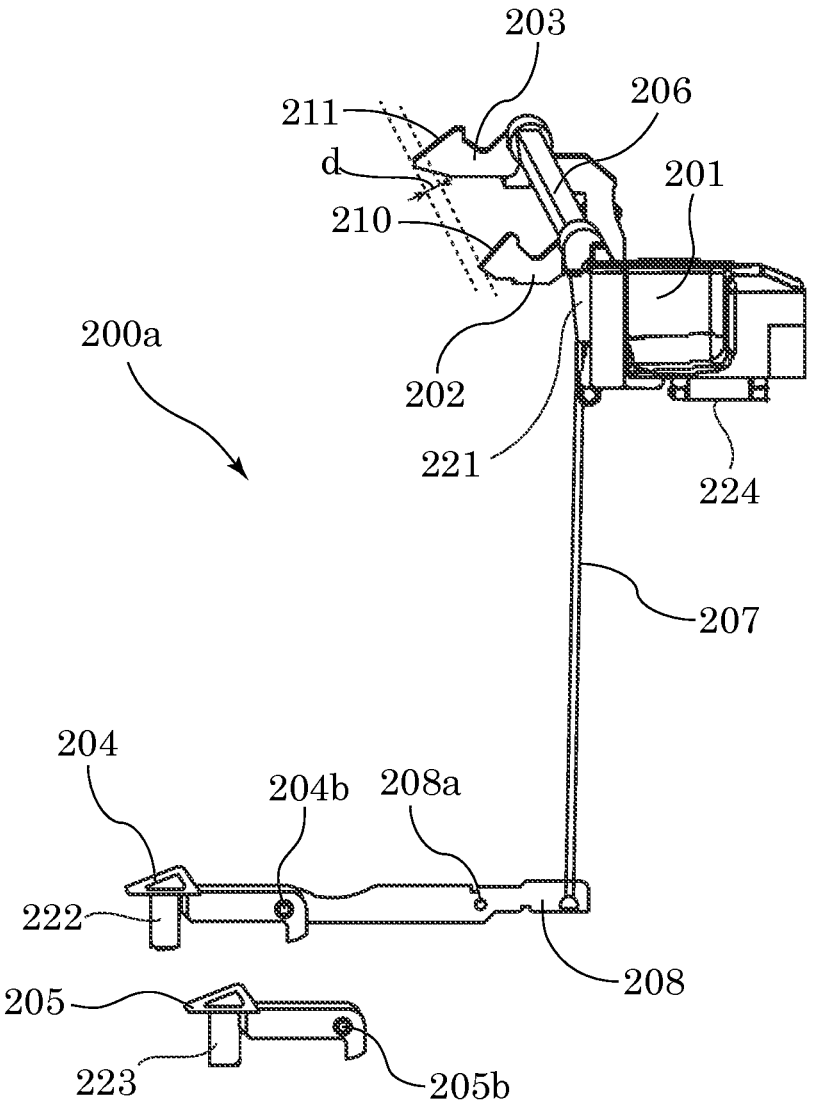
FIG. 8 is a perspective view showing a configuration of the lock mechanism.

Next, a third interlock portion 40, partly composed of the third interlock hook 204, and an independent lock portion 50, partly composed of the independent hook 205, will be explained in detail. As shown in FIGS. 7A and 8, the third interlock portion 40 is composed of the third interlock hook 204 and a hooking rib 136*a* formed along a guide rail 136 and disposed above the third interlock hook 204. The third interlock hook 204 is configured to turn together with the turning a link arm 208 through a rotation shaft 204*b*. The link arm 208 rotates about a turning shaft 208*a*. The third interlock hook 204 is provided with an inclined surface 204*a* inclined downward toward a direction in which the duplex unit 135 is stored in the apparatus body (in a direction of an arrow indicated in FIG. 7A) and an engage surface 204*c* is inclined downward toward a direction in which the duplex unit 135 is drawn out and from an apex portion of the inclined surface 204*a*. The third interlock hook 204 turns between a lock position where the engage surface 204*c* engages with the hooking rib 136*a* of the guide rail 136 and a unlock position where the engage surface 204*c* is disengaged from the hooking rib 136*a* by turning downward from the third lock position. A spring 222 is provided under the third interlock hook 204 such that the third interlock hook 204 is biased by the spring 222 to the lock position. It is noted that a rotation angle of the third interlock hook 204 biased by the spring 222 is restricted by a stopper not shown provided in the link arm 208.

Figure 7B:
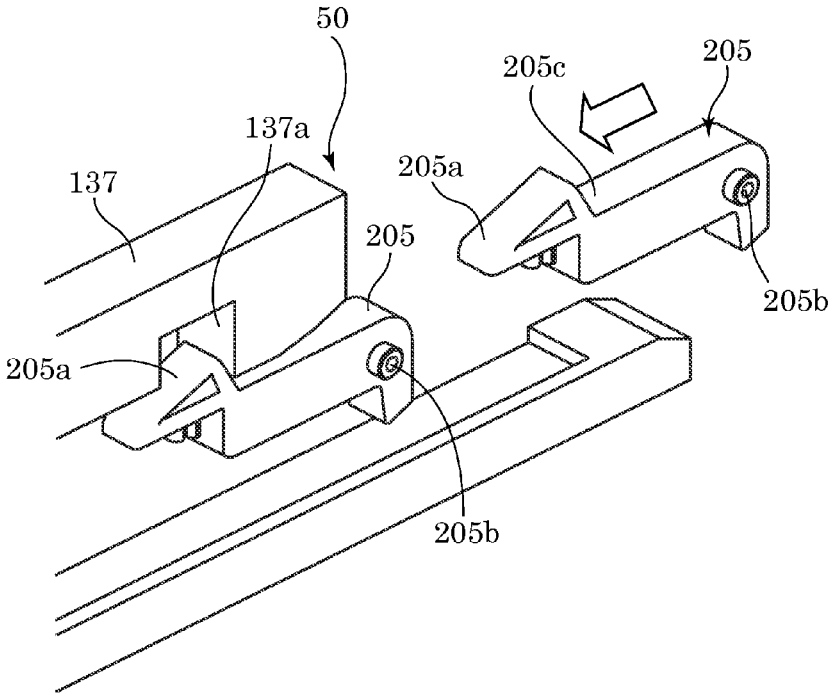
FIG. 7B is a perspective view showing a locking operation of an independent hook.

As shown in FIGS. 7B and 8, the independent lock portion 50 is composed of an independent hook 205 and a lock concave portion (engage portion) 137*a* formed through the guide rail 137 and disposed above the independent hook 205. Formed on an upper surface of the independent hook 205 are an inclined surface 205*a* inclined downward toward a direction (direction of an arrow indicated in FIG. 7B) in which the duplex unit 135 is stored in the apparatus body and an engage surface 205*c* inclined downward in the direction in which the duplex unit 135 is drawn out from an apex portion of the inclined surface 205*a* and extending substantially horizontally. The independent hook 205 turns between a fourth lock position where the engage surface 205*c* engages with the locking concave portion 137*a* of the guide rail 137 and a unlock position where the independent hook 205 turns downward from the lock position and the engage surface 205*c* is disengaged from the locking concave portion 137*a*. A spring (independent side bias portion) 223 is provided under the independent hook 205 such that the independent hook 205 is biased by the spring 223 to the lock position. A bias force of the spring 223 is greater than the bias force of the springs 220 and 222 of the interlocked lock mechanism 200 described above. A rotation angle of the independent hook 205 biased by the spring 223 is restricted by a stopper not shown provided on the support portion 135*a*.

Then, when the duplex unit 135 is moved and stored into the storage portion 100D, the third interlock hook 204 passes through the hooking rib 136*a* while being depressed by the hooking rib 136*a* of the guide rail 136 as shown in FIG. 7A. When the third interlock hook 204 passes through the hooking rib 136*a*, the third interlock hook 204 turns upward by being biased by the spring 222 and moves to the lock position where the engage surface 204*c* is locked by the hooking rib 136*a*.

When the duplex unit 135 is moved and stored into the storage portion 100D, the inclined surface 205*a* of the independent hook 205 reaches the locking concave portion 137*a* formed at an under surface of the guide rail 137 while being depressed by the under surface of the guide rail 137 as shown in FIG. 7B and turns upward by being biased by the spring 223. Thereby, the independent hook 205 moves to the lock position where the engage surface 205*c* is locked by the locking concave portion 137*a*. When the duplex unit 135 is thus stored into the storage portion 100D, the duplex unit 135 is locked in the storage portion 100D by the interlocked lock mechanism 200 including the first, second and third interlock portions 20, 30 and 40, and by the independent lock mechanism 300 including the independent lock portion 50.

Meanwhile, the duplex unit 135 locked by the interlocked lock mechanism 200 is unlocked by manipulating the opening/closing lever 201. The opening/closing lever 201 is provided slidably in a rear direction at one widthwise end side of the duplex unit 135 and is slidingly moved rearward in unlocking the duplex unit 135 locked by the interlocked lock mechanism 200 in the present embodiment.

It is noted that the opening/closing lever 201 is linked with the lock shaft 206 through the intermediary of the interlock mechanism not shown as described above. Thereby, when the opening/closing lever 201 is slidingly moved rearward, the lock shaft 206 turns counterclockwise and due to that, the first and second interlock hooks 202 and 203 turn downward, i.e., in the direction of being unlocked from the square holes 140*a* and 140*b* of the hooking sheet metal 140. Still further, due to the turn of the second interlock hook 203, the wire 207 is moved and the link arm 208 is pulled up. Along with that, the third interlock hook 204 moves downward, i.e., in the direction of being unlocked from the hooking rib 136*a*. That is, the turn of the lock shaft 206 is transmitted to the third interlock hook 204 by the second interlock hook 203 and the wire 207 through the intermediary of the link arm 208, so that the third interlock hook 204 is moved.

As shown in FIGS. 2 and 8, the lock shaft 206, the wire 207, the link arm 208 and the opening/closing lever 201 compose the interlocking portion 200*a* interlocking the first through third interlock hooks 202 through 204 in the present embodiment as described above. Still further, the independent hook 205 located on an operation side where the user operates the image forming apparatus 100 is configured independently from the first through third interlock hooks 202 through 204 so that the user can readily feel an operation feeling by the force of the spring and others in opening/closing the duplex unit 135 by operating the opening/closing lever 201.

Next, an operation for drawing out the duplex unit 135 in the image forming apparatus 100 including the interlock lock mechanism 200 and the independent lock mechanism 300 constructed as described above will be explained. In a case where jamming of the sheet or the like occurs in the duplex unit 135 for instance, the user slidingly moves the opening/closing lever 201 rearward at first. Thereby, the lock shaft 206 turns counterclockwise, the first interlock hook 202 turns downward and moves to the unlock position where the first interlock hook 202 is unlocked from the square hole 140*a* of the hooking sheet metal 140, and the second interlock hook 203 turns downward and moves to the unlock position where the second interlock hook 203 is unlocked from the square hole 140*b* of the hooking sheet metal 140.

Still further, along with the counterclockwise turn of the lock shaft 206, the wire 207 is pulled up and the link arm 208 turns counterclockwise centering on the turning shaft 208*a* shown in FIG. 8. Thereby, the third interlock hook 204, turning together with the link arm 208 and centering on the rotation shaft 204*b*, turns downward by resisting against the bias force of the spring 222 and is unlocked from the hooking rib 136*a* of the guide rail 136. Thus, when the opening/closing lever 201 is slidingly moved rearward, the first through third interlock hooks 202 through 204 move from the lock positions to the unlock positions, respectively, making it possible to move the duplex unit 135 in the drawing direction. It is noted that the opening/closing lever 201 is biased forward by a spring 224 as shown in FIG. 8 and the opening/closing lever 201 that has been slidingly moved rearward by the user in unlocking the first through third interlock hooks 202 through 204 slidingly moves forward by the spring 224 when the user releases user's hand from the opening/closing lever 201 and returns to its original position.

Figure 9:
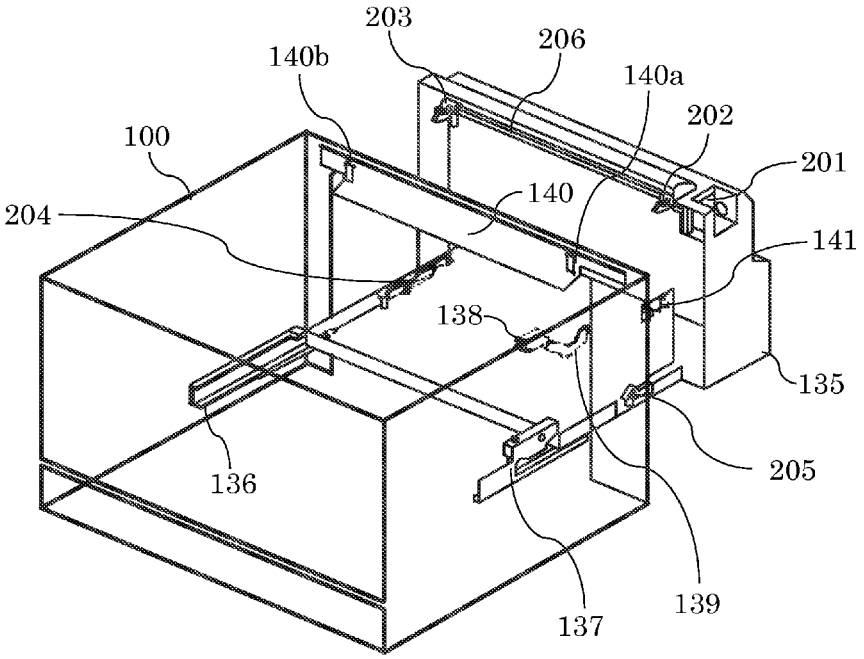
FIG. 9 is a perspective view showing a state in which the duplex unit is drawn out of the apparatus body.

Then, when the user moves the duplex unit 135 in the drawing direction, the engage surface 205*c* of the independent hook 205 located at the lock position drops by resisting against the bias force of the spring 223 while abutting against the lock concave portion 137*a* and the independent hook 205 moves to the unlock position where the independent hook 205 is unlocked from the lock concave portion 137*a*. Then, when the user moves the duplex unit 135 further in the drawing direction, the inclined surface 205*a* of the independent hook 205 moves while abutting against the guide rail 137 and when the inclined surface 205*a* separates from the guide rail 137, the independent hook 205 moves again to the lock position by the bias force of the spring 223. Thereby, the duplex unit 135 is unlocked from the four hooks 202 through 205 of the interlock lock mechanism 200 and the independent lock mechanism 300 and can be drawn out as shown in FIGS. 9 and 4 as described above.

Next, an operation for storing the duplex unit 135 that has been drawn out as described above into the storage portion 100D of the apparatus body 100A will be explained. When the unjamming work or the like is finished in the state in which the duplex unit 135 is drawn out, the user slides the duplex unit 135 in a storage direction. Thereby, the inclined surfaces 210 and 211 of the first and second interlock hooks 202 and 203 abut against the upper edge portions of the square holes 140*a* and 140*b* of the hooking sheet metal 140 and turn downward respectively. Thereby, the first and second interlock hooks 202 and 203 move respectively to the unlock positions. As shown in FIGS. 6A and 6B described above, the first and second interlock hooks 202 and 203 move to the lock positions where they are locked respectively by the upper edge portions of the square holes 140*a* and 140*b* due to the bias force of the spring 220 after when the inclined surfaces 210 and 211 of the first and second interlock hooks 202 and 203 pass through the square holes 140*a* and 140*b* of the hooking sheet metal 140. The inclined surfaces 204*a* and 205*a* of the third interlock hook 204 and the independent hook 205 also abut against the guide rails 136 and 137, respectively, and turn downward. Thereby, the third interlock hook 204 and the independent hook 205 move to the unlock positions, respectively. Then, when the duplex unit 135 is slid further in the storage direction, the third interlock hook 204 and the independent hook 205 move to the lock positions where the engage surfaces 204*c* and 205*c* of the third interlock hook 204 and the independent hook 205 are locked respectively by the hooking rib 136*a* of the guide rail 136 and the lock concave portion 137*a* of the guide rail 137 as shown in FIGS. 7A and 7B described above. It is noted that the first through third interlock hooks 202 through 204 are turned in the same time by the interlocking portion 200*a* described above. Thereby, the duplex unit 135 is locked in the state in which the duplex unit 135 is stored in the storage portion 100D by the four hooks 202 through 205 of the interlock lock mechanism 200 and the independent lock mechanism 300.

Figure 10A:
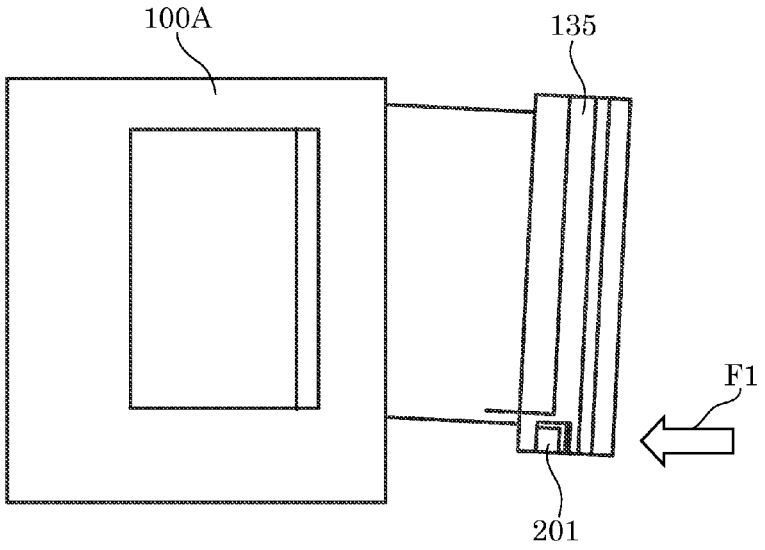
FIG. 10A is a schematic view showing a posture of the duplex unit when the duplex unit is mounted to the apparatus body in a state in which a force is applied to a first end side of the duplex unit.
Figure 10B:
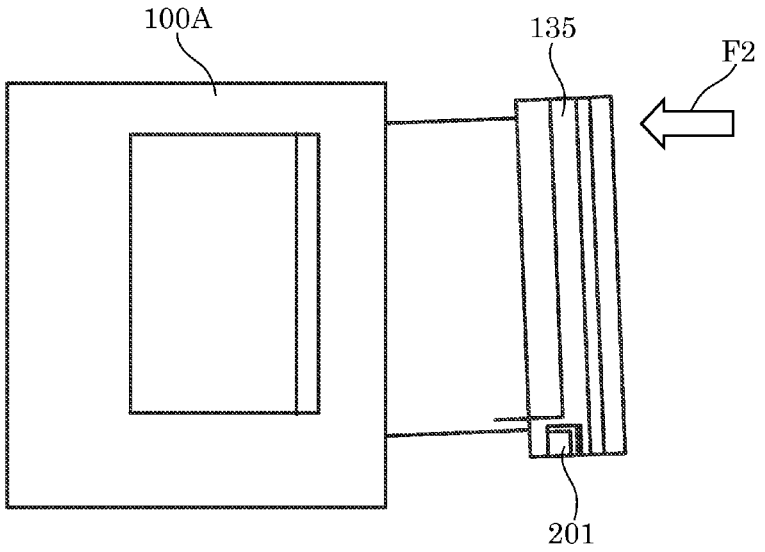
FIG. 10B is a schematic view showing a posture of the duplex unit when the duplex unit is mounted to the apparatus body in a state in which a force is applied to a second end side of the duplex unit.

By the way, it is necessary to lock at least the first and second interlock hooks 202 and 203 to the hooking sheet metal 140 almost in the same time in order to store the duplex unit 135 into the image forming apparatus 100 without causing unbalanced closure. However, there is a case where the duplex unit 135 cannot be stored straightly into the storage portion 100D depending on how the user apples a force to the duplex unit 135 in storing the duplex unit 135 into the storage portion 100D. For instance, if a force F1 is applied to the duplex unit 135 from the opening/closing lever 201 side (the widthwise first end side) as shown in FIG. 10A, the duplex unit 135 is stored in an inclined condition as shown in FIG. 10A if the image forming apparatus is a conventional image forming apparatus. If a force F2 is applied to the duplex unit 135 from the side opposite from the opening/closing lever 201 side (the widthwise other end side), the duplex unit 135 is stored in an inclined condition as shown in FIG. 10B if the image forming apparatus is the conventional image forming apparatus.

Then, if the duplex unit 135 is stored in the inclined condition, the duplex unit 135 is put into an unbalanced closure condition in which only one of the first interlock lock portion 20 and the second interlock lock portion 30 is locked. In this condition, such troubles that an image formed on a sheet is inclined or a sheet is jammed are liable to occur. Due to that, in the present embodiment, the first and second interlock hooks 202 and 203 are configured to be locked by the hooking sheet metal 140 in the same time when the duplex unit 135 is stored in the inclined condition as shown in FIG. 10A for example.

That is, in order to lock the first and second interlock hooks 202 and 203 to the hooking sheet metal 140 almost in the same time, a length of the second interlock hook 203 from the lock shaft 206 to a tip of the inclined surface 211 is set to be longer than a length of the first interlock hook 202 from the lock shaft 206 to a tip of the inclined surface 210 by a predetermined length d as shown in FIG. 8 described above. That is, the second interlock hook 203 is formed to be longer than the first interlock hock 202 in the drawing direction facing the apparatus body 100A.

This predetermined length d is a length by which the inclined surface 211 of the second interlock hook 203 reaches the hooking sheet metal 140 almost in the same time with the inclined surface 210 of the first interlock hook 202 when the duplex unit 135 is stored with a maximum inclination on the first interlock hook 202 side as shown in FIG. 10A. Thereby, even if the duplex unit 135 is stored with an inclined posture as shown in FIG. 10A, the inclined surface 211 of the second interlock hook 203 abuts against the upper edge portion of the square hole 140*b* preceding to the abutment of the inclined surface 210 of the first interlock hook 202 against the upper edge portion of the square hole 140*a* of the hooking sheet metal 140. Accordingly, even if the concave portion 202*a* of the first interlock hook 202 is in the condition relatively closer to the hooking sheet metal 140 than the concave portion 203*a* of the second interlock hook 203 due to the inclined posture taken by the duplex unit 135 as shown in FIG. 10A, the inclined surface 211 of the second interlock hook 203 abuts against the upper edge portion of the square hole 140*b* at first and the first and second interlock hooks 202 and 203 interlock and turn downward, so that the first interlock hook 202 is not moved to the lock position as long as the inclined surface 211 of the second interlock hook 203 abuts against the upper edge portion of the square hole 140*b*. This arrangement makes it possible to prevent the unbalanced closure of the duplex unit 135.

Still further, because the concave portions 202*a* and 203*a* of the first and second interlock hooks 202 and 203 are disposed so as to be arrayed in a direction in parallel with an axial direction of the lock shaft 206, so that when the inclined posture of the duplex unit 135 is corrected as described later and the duplex unit 135 takes a storage posture straightened in the storage direction, the first and second interlock hooks 202 and 203 can be locked to the hooking sheet metal 140 almost at the same time.

Here, in the case where the force F1 (see FIG. 10A) is applied to the duplex unit 135 from the opening/closing lever 201 side (the widthwise first end portion), the force applied to the second interlock hook 203 side (the widthwise other end portion) based on the force F1 is smaller than the force applied to the first interlock hook 202 side. Due to that, there is a possibility that the second interlock hook 203 cannot pass through the square hole 140*b* of the hooking sheet metal 140 even if the second interlock hook 203 reaches the hooking sheet metal 140 in the same time with the first interlock hook 202.

Then, in the present embodiment, the inclined surface 211 of the second interlock hook 203 is formed such that an inclination angle thereof is smaller than that of the inclined surface 210 of the first interlock hook 202 and the inclined surface 211 is formed to be closer to horizontal as compared to the inclined surface 210 as shown in FIGS. 6A and 6B. This arrangement makes it possible to reduce friction caused when the inclined surface 211 of the second interlock hook 203 abuts against the upper edge portion of the square hole 140*a* and the second interlock hook 203 can readily pass through the square hole 140*a* of the hooking sheet metal 140 as compared to the first interlock hook 202. As a result, the second interlock hook 203 can be turned even in the case where the force applied to the second interlock hook 203 side is small, and the first and second interlock hooks 202 and 203 can pass through the hooking sheet metal 140 almost in the same time.

In the present embodiment, if the duplex unit 135 is pushed into the storage portion 100D with the inclined posture as shown in FIG. 10A, the independent hook 205 reaches the guide rail 137 and moves in the storage direction while turning downward by resisting against the bias force of the spring 223 preceding to that the duplex unit 135 is locked to the storage portion 100D by the first, second and third interlock lock portions 20, 30 and 40. At this time, the duplex unit 135 causes a resistance force through an intermediary of the independent lock portion 50 composing the independent lock mechanism 300 due to the bias force of the spring 223. At this time, even if either one hook of the first, second and third interlock lock portions 20, 30 and 40 (i.e., either one hook of the first through third interlock hooks 202 through 205) composing the interlock lock mechanism 300 turns by resisting against the bias force of the springs 220 and 222 and the duplex unit 135 causes a resistance force by the interlock lock mechanism 200, the resistance force caused by the independent lock mechanism 300 is set to be greater than the resistance force caused by the interlock lock mechanism 200. Thereby, along with the application of the force F1 to the duplex unit 135, the duplex unit 135 turns in a direction (counterclockwise) of being corrected from the inclined posture shown in FIG. 10A to the storage posture centering around the independent lock portion 50. This arrangement makes it possible to lock the duplex unit 135 to the storage portion 100D by the first, second and third interlock lock portions 20, 30 and 40 almost in the same time in the state in which the duplex unit 135 takes the storage position.

It is noted that the independent lock portion 50 is arranged to lock the duplex unit 135 to the storage portion 100D after when all of the first, second and third interlock lock portions 20, 30 and 40 lock the duplex unit 135 to the storage portion 100D in the present embodiment. Therefore, when the independent hook 205 moves to the lock position by the spring 223 when the independent lock portion 50 is put into the lock state, a feeling of operation of completing the lock is given to the user. Therefore, the user can know by this operation feeling that the duplex unit 135 has been stored and locked.

Meanwhile, as shown in FIG. 10B, there is the case when the force F2 is applied to the duplex unit 135 from the second interlock hook 203 side (i.e., the widthwise other end side). In this case, the duplex unit 135 slides in the storage direction while taking an inclined posture as shown in FIG. 10B. The second and third interlock lock portions 30 and 40 lock the duplex unit 135 to the storage portion 100D before the first interlock lock portion 20 and the independent lock portion 50 are put into the lock condition. As a result, there is a case where the duplex unit 135 is closed in an unbalanced manner. There is also a case where a force is applied to the duplex unit 135 from a widthwise center side rather than the second interlock hook 203 side. Because a distance from the position where the force is applied to the independent hook 205 is long also in this case, a force exceeding the resistance force caused in the duplex unit 135 when the independent lock portion 50 is put into the lock state does not act on the first interlock lock portion 20 and the independent lock portion 50 side, so that there is a case when the duplex unit 135 is closed in an unbalanced manner.

If the duplex unit 135 is thus put into the unbalanced closure condition while being inclined as shown in FIG. 10B, the switch arm 141 is unable to press the flag 139 and the detection switch 138 which is provided on the widthwise first end side (on the independent hook 205 side) is kept in the OFF condition. Then, if the detection switch 138 is not turned ON, the control portion not shown displays that the duplex unit 135 is opened on a display portion not shown. This display allows the user to recognize that the duplex unit 135 is in the unbalanced closure condition. It is noted that this display portion also displays that the image forming apparatus is in a standby condition when the independent lock portion 50 locks the duplex unit 135 to the storage portion 100D and the detection switch 138 is turned ON.

As described above, the vicinity of the opening/closing lever 201 is pushed in storing the duplex unit 135 in the present embodiment. Thereby, the duplex unit 135 can be locked by the first, second and third interlock lock portions 20, 30 and 40 and the independent lock portion 50 even if the duplex unit 135 takes the inclined posture as shown in FIG. 10A. This effect is brought about by differentiating the shapes of the first and second interlock hooks 202 and 203 and by the resistance force caused in the duplex unit 135 through the intermediary of the independent lock portion 50 as described above.

It is noted there is also the case when the duplex unit 135 is tried to be stored by operating the side opposite widthwise from the opening/closing lever 201 for example as shown in FIG. 10B, without operating the vicinity of the opening/closing lever 201. In this case, there is such a case that the first interlock lock portion 20 and the independent lock portion 50 cannot be locked even though the second and third interlock lock portions 30 and 40 can be locked by the force applied to the duplex unit 135 by the user and by the interlocking portion 200*a*. In such a case, it is possible to reliably detect that the duplex unit 135 is in the unbalanced closure condition by the detection switch 138.

It is noted that although the opening/closing lever 201 is disposed at the widthwise first end side of the duplex unit 135 in the present embodiment, the opening/closing lever 201 can be disposed on the widthwise other end side of the duplex unit 135. The opening/closing lever 201 also may be disposed on the apparatus body 100A side, not the duplex unit 135 side.

The first through third interlock hooks 202 through 204 and the independent hook 205 may be provided on the apparatus body 100A side, not the duplex unit 135 side. In such a case, these first through third interlock hooks 202 through 204 and the independent hook 205 provided on the apparatus body 100A side engage with engage portions provided on the duplex unit 135.

Still further, although the first through third interlock hooks 202 through 204 and the independent hook 205 are configured to turn vertically and to move between the lock positions and the unlock positions, respectively, they may be arranged so as to turn in horizontal or other directions.

Still further, while three of the first, second and third interlock lock portions 20, 30 and 40 are provided in the present embodiment, the third interlock lock portion 40 may be omitted and the interlock lock portions may be two for example, or four or more interlock lock portions may be provided. Disposition of these interlock lock portions may be freely set. Still further, not only one but a plurality of non-interlocked independent lock portions 50 may be provided. The bias member biasing the independent hook 205 to the lock position is not limited to the spring 223 and may be another elastic member such as rubber or may be a magnet.

It is also possible to arrange such that the resistance force caused in the duplex unit 135 when the independent hook 205 moves from the lock position to the unlock position is caused by another member such as a friction pad for example, not by the bias member such as the spring 223.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-236200, filed Nov. 14, 2013, which is hereby incorporated by reference herein in its entirety.

What is claimed is:

1. An image forming apparatus comprising:

an apparatus body;

a drawer unit configured to be drawably stored in the apparatus body;

a plurality of interlocked lock portions configured to lock the drawer unit to the apparatus body in a state in which the drawer unit is stored in the apparatus body;

an interlocking portion configured to interlock the interlocked lock portions; and an independent lock portion configured to lock the drawer unit to the apparatus body independently from the plurality of interlocked lock portions in a state in which the drawer unit is stored, the independent lock portion locking a first end side of the drawer unit, in a direction orthogonal to a drawing direction of the drawer unit, to the apparatus body, wherein a resistance force caused in the first end side of the drawer unit in storing the drawer unit is greater than a resistance force caused in a second end side of the drawer unit in the direction orthogonal to the drawing direction in storing the drawer unit.

2. The image forming apparatus according to claim 1, wherein a resistance force caused in the drawer unit by the independent lock portion in storing the drawer unit is greater than a resistance force caused in the drawer unit by the plurality of interlocked lock portions in storing the drawer unit.

3. The image forming apparatus according to claim 1, wherein the independent lock portion is configured to cause, in storing the drawer unit, a resistance force in the drawer unit prior to the plurality of interlocked lock portions locking the drawer unit to the apparatus body, the drawer unit being locked to the apparatus body after all of the plurality of interlocked lock portions lock the drawer unit to the apparatus body.

4. The image forming apparatus according to claim 1, further comprising:

an interlock side bias portion biasing the plurality of interlocked lock portions into a locked state in which the drawer unit is locked to the apparatus body, the interlock side bias portion generating a bias force; and an independent side bias portion biasing the independent lock portion into a locked state in which the drawer unit is locked to the apparatus body, the independent side bias portion generating a bias force greater than the bias force of the interlock side bias portion.

5. The image forming apparatus according to claim 1, wherein the plurality of interlocked lock portions includes:

a first interlocked lock portion arranged to lock the first end side of the drawer unit to the apparatus body, the first interlocked lock portion having:

a first interlocked lock member movable between a locked position where the first interlocked lock member locks the drawer unit to the apparatus body and an unlocked position where the drawer unit is unlocked; and a first engaging portion that engages with the first interlocked lock member in the locked position; and a second interlocked lock portion arranged to lock the second end side of the drawer unit to the apparatus body, the second interlocked lock portion having:

a second interlocked lock member movable between a locked position where the second interlocked lock member locks the drawer unit to the apparatus body and an unlocked position where the drawer unit is unlocked; and a second engaging portion that engages with the second interlocked lock member in the locked position.

6. The image forming apparatus according to claim 5, wherein the first interlocked lock member is provided on the drawer unit at the first end side, the first engaging portion is provided on the apparatus body at the first end side, the second interlocked lock member is provided on the drawer unit at the second end side, the second engaging portion is provided on the apparatus body at the second end side, and the interlocking portion includes a releasing portion provided at the first end side, the releasing portion moving the first and second interlocked lock members from the locked position to the unlocked position.

7. The image forming apparatus according to claim 5, wherein the second interlocked lock member is longer than the first interlocked lock member in a direction extending toward the apparatus body.

8. The image forming apparatus according to claim 5, wherein the first interlocked lock member is provided with a first inclined surface formed so as to move the first interlocked lock member from the locked position to the unlocked position by abutting against the first engaging portion when the drawer unit is stored into the apparatus body, the first inclined surface having an inclination angle, the second interlocked lock member is provided with a second inclined surface formed so as to move the second interlocked lock member from the locked position to the unlocked position by abutting against the second engaging portion when the drawer unit is stored into the apparatus body, the second inclined surface having an inclination angle that is smaller than the inclination angle of the first inclined surface.

9. The image forming apparatus according to claim 5, wherein the independent lock portion is disposed under the first interlocked lock portion in a state in which the drawer unit is stored in the apparatus body.

10. The image forming apparatus according to claim 5, wherein the plurality of interlocked lock portions includes a third interlocked lock portion interlocked with the first and second interlocked lock portions by the interlocking portion and arranged to lock the second end side of the drawer unit.

11. The image forming apparatus according to claim 10, wherein the third interlocked lock portion is disposed under the second interlocked lock portion and the independent lock portion is disposed under the first interlocked lock portion in a state in which the drawer unit is stored in the apparatus body.

12. The image forming apparatus according to claim 1, further comprising a detection portion configured to detect that the independent lock portion has locked the drawer unit to the apparatus body.

13. The image forming apparatus according to claim 1, further comprising:

a bias portion biasing the independent lock portion into a locked position in which the drawer unit is locked to the apparatus body, wherein the resistance force is caused in the first end side of the drawer unit by the bias portion through the independent lock portion in storing the drawer unit.

14. An image forming apparatus comprising:

an apparatus body;

a drawer unit configured to be drawably stored in the apparatus body;

a first interlocked lock member arranged to lock a first end side of the drawer unit in a width direction orthogonal to a drawing direction of the drawer unit to the apparatus body;

a second interlocked lock member arranged to lock a second end side of the drawer unit in the width direction to the apparatus body;

a third interlocked lock member disposed under the second interlocked lock member, the third interlocked lock member being interlocked with the first and second interlocked lock members and locking the second end side of the drawer unit in the width direction to the apparatus body; and an independent lock member configured to lock the drawer unit to the apparatus body independently from the first, second and third interlocked lock members and arranged so as to lock the first end side of the drawer unit in the width direction to the apparatus body.

15. The image forming apparatus according to claim 14, further comprising a detection portion disposed at the first end side of the apparatus body in the width direction and configured to detect that the independent lock member has locked the drawer unit to the apparatus body.

16. The image forming apparatus according to claim 14, wherein the independent lock member is disposed under the first interlocked lock member.

17. The image forming apparatus according to claim 14, wherein a resistance force caused in the first end side of the drawer unit in storing the drawer unit is greater than a resistance force caused in the second end side of the drawer unit in storing the drawer unit to the apparatus body.

18. The image forming apparatus according to claim 14, wherein the independent lock member is configured such that a resistance force caused in the drawer unit by the independent lock member in storing the drawer unit is greater than a resistance force caused in the drawer unit by the first, second, and third interlocked lock members in storing the drawer unit.

19. The image forming apparatus according to claim 14, wherein the independent lock member is configured to cause, in storing the drawer unit, a resistance force in the drawer unit prior to the first, second, and third interlocked lock members locking the drawer unit to the apparatus body, the drawer unit being locked to the apparatus body after all of the first, second and, third interlocked lock members lock the drawer unit to the apparatus body.

20. The image forming apparatus according to claim 14, further comprising:

a bias portion biasing the independent lock member into a locked position in which the drawer unit is locked to the apparatus body, the bias portion causing a resistance force in the first end side of the drawer unit through the independent lock member in storing the drawer unit.

* * * * *